US008393307B2

(12) United States Patent
Lee et al.

(10) Patent No.: US 8,393,307 B2
(45) Date of Patent: Mar. 12, 2013

(54) VARIABLE COMPRESSION RATIO DEVICE

(75) Inventors: Ju Hun Lee, Gwangmyung-si (KR); Eun Ho Lee, Hwaseong (KR); Jin-Kook Kong, Suwon (KR); Soo-Hyung Woo, Yongin (KR)

(73) Assignee: Hyundai Motor Company, Seoul (KR)

( * ) Notice: Subject to any disclaimer, the term of this patent is extended or adjusted under 35 U.S.C. 154(b) by 411 days.

(21) Appl. No.: 12/857,475

(22) Filed: Aug. 16, 2010

(65) Prior Publication Data

US 2011/0108006 A1 May 12, 2011

(30) Foreign Application Priority Data

Nov. 10, 2009 (KR) ..... 10-2009-0108239

(51) Int. Cl.
*F02B 75/04* (2006.01)

(52) U.S. Cl. ..... 123/48 B; 123/78 BA

(58) Field of Classification Search ..... 123/48 R, 123/48 B, 78 R, 78 B, 78 BA
See application file for complete search history.

(56) References Cited

U.S. PATENT DOCUMENTS 2,151,853 A * 3/1939 Jonville et al. ..... 123/78 BA
5,417,185 A * 5/1995 Beattie ..... 123/48 B

* cited by examiner

*Primary Examiner* — Noah Kamen
(74) *Attorney, Agent, or Firm* — Morgan, Lewis & Bockius LLP

(57) ABSTRACT

A variable compression ratio device including a piston, a crankshaft, and a connecting rod may include an eccentric bearing that contacts an exterior circumference of the piston pin, wherein an exterior circumference of the eccentric bearing contacts an interior circumference of a ring formed at the small end of the connecting rod, a ratchet rod slidably coupled inside the piston pin and movable along a longitudinal direction, a variable slider that selectively contacts one of both ends of the ratchet rod, and that is disposed at both sides of a cylinder for pushing the one of both ends of the ratchet rod in an opposite direction, and a guide plate for reciprocally moving both variable sliders along a vertical direction of the ratchet rod.

14 Claims, 6 Drawing Sheets

VARIABLE COMPRESSION RATIO DEVICE

CROSS-REFERENCE TO RELATED APPLICATION

The present application claims priority to Korean Patent Application No. 10-2009-0108239 filed on Nov. 10, 2009, the entire contents of which is incorporated herein for all purposes by this reference.

BACKGROUND OF THE INVENTION

1. Field of the Invention

The present invention relates to a variable compression ratio device, and more particularly to a variable compression ratio device that is capable of changing a compression ratio of a mixture in a combustion chamber corresponding to driving conditions of an engine.

2. Description of Related Art

Generally, thermal efficiency of combustion engines increases as the compression ratio thereof increases, and if ignition timing is advanced to some degree, thermal efficiency of spark-ignition engines increases.

However, if the ignition timing of the spark-ignition engines is advanced at a high compression ratio, abnormal combustion may occur and the engine may be damaged. Thus, the ignition timing cannot be advanced a great deal and accordingly engine output may deteriorate.

A variable compression ratio (VCR) apparatus changes the compression ratio of an air-fuel mixture according to a driving state of an engine.

The variable compression ratio apparatus raises the compression ratio of the air-fuel mixture at a low-load condition of the engine in order to improve fuel mileage.

On the contrary, the variable compression ratio apparatus lowers the compression ratio of the air-fuel mixture at a high-load condition of the engine in order to prevent occurrence of knocking and to improve engine output.

A conventional variable compression ratio apparatus can achieve a predetermined compression ratio of the air-fuel mixture according to a driving state of the engine, but it cannot achieve different strokes corresponding to intake/compression/expansion/exhaust strokes, respectively.

Particularly, if the stroke of the expansion stroke is longer than that of the compression stroke, thermal efficiency may further improve. However, it is difficult to achieve a longer expansion stroke than compression stroke according to the conventional variable compression ratio apparatus.

In addition, a high compression ratio/low exhaust amount at a low load condition and a low compression ratio/high exhaust amount at a high load condition may be preferable in order to achieve low fuel consumption and high power output.

Herein, since oil pressure or an electric motor etc. must be provided as an actuator in order to change the compression ratio of cylinder volume, the size of a pump is increased, and also electrical load is increased due to an electric motor of large capacity.

The information disclosed in this Background of the present invention section is only for enhancement of understanding of the general background of the present invention and should not be taken as an acknowledgement or any form of suggestion that this information forms the prior art already known to a person skilled in the art.

BRIEF SUMMARY OF THE INVENTION

Various aspects of the present invention are directed to provide a variable compression ratio device having advantages of controlling a compression ratio inside a cylinder and improving fuel mileage.

In an aspect of the present invention, the variable compression ratio device including a piston, a crankshaft, and a connecting rod including a small end rotatably connected to the piston by a piston pin and a big end rotatably connected to the crankshaft, may include an eccentric bearing that contacts an exterior circumference of the piston pin, wherein an exterior circumference of the eccentric bearing contacts an interior circumference of a ring formed at the small end of the connecting rod and a central portion of the exterior circumference of the eccentric bearing is eccentric with a central portion of an interior circumference thereof, a ratchet rod slidably coupled inside the piston pin and movable along a longitudinal direction therein to make selectively a relative rotation between the eccentric bearing and the small end of the connecting rod in accordance with a longitudinal motion of the ratchet rod, a variable slider that selectively contacts one of both ends of the ratchet rod, and that is disposed at both sides of a cylinder for pushing the one of both ends of the ratchet rod in an opposite direction, and a guide plate for reciprocally moving both variable sliders along a vertical direction of the ratchet rod, wherein one end of the variable shaft is connected to the variable slider, and a sliding direction of the variable slider is controlled by a rotation of the variable shaft.

The device may further include an oil groove formed at the exterior circumference of the eccentric bearing, wherein a partition partitioning the oil groove is integrally formed at an interior circumference of the ring in the small end and engaged in the oil groove, and wherein oil holes are formed in the oil groove in lateral side thereof in a circumferential direction thereof.

The device may further include an oil supply passage formed inside the connecting rod for supplying oil to the oil groove through the oil holes, wherein the eccentric bearing includes an oil input passage fluid-connected to the oil supply passage of the connecting rod.

The piston pin may include an oil inlet passage fluid-connected to the oil input passage of the eccentric bearing and includes oil outlet passages.

A control oil passage may be formed along outer circumference of the ratchet rod, and the oil supplied from the oil supply passage through the oil input passage of the eccentric bearing and the oil inlet passage of the piston pin is selectively supplied to one of the oil outlet passages according to a reciprocal motion of the ratchet rod, by the control oil passage of the piston pin being selectively connected to the one of the oil output passages of the piston pin which is fluid-connected to one side of the oil groove separated by the partition.

The eccentric bearing may include inner grooves formed along inner circumference thereof and fluid-communicating with respective oil outlet passage of the piston pin and respectively fluid-connected to the oil holes formed in the one side and the other side of the oil groove.

A protrusion may be formed at an interior circumference of the variable slider so as to be respectively corresponded to both ends of the ratchet rod, and both protrusions are disposed so as to be respectively relocated back and forth about each moving direction.

The variable shaft and the variable slider may be connected by a connecting shaft.

An adaptor may be mounted at an exterior circumference of the variable shaft so as to rotate together, the variable shaft and the connecting shaft are connected to each other by a first hinge disposed at the adaptor, the connecting shaft is connected to the variable slider by a second hinge, and rotary motion of the connecting shaft is converted to reciprocal motion by the first hinge and the second hinge.

A guide rail may be formed at one side of the guide plate for guiding the variable slider to move reciprocally back and forth, and a fixing block is formed at a lower side thereof for fixedly connecting the guide plate.

The variable shaft may be operated by a separate actuator of a vacuum type.

The methods and apparatuses of the present invention have other features and advantages which will be apparent from or are set forth in more detail in the accompanying drawings, which are incorporated herein, and the following Detailed Description of the present invention, which together serve to explain certain principles of the present invention.

Figure 1:
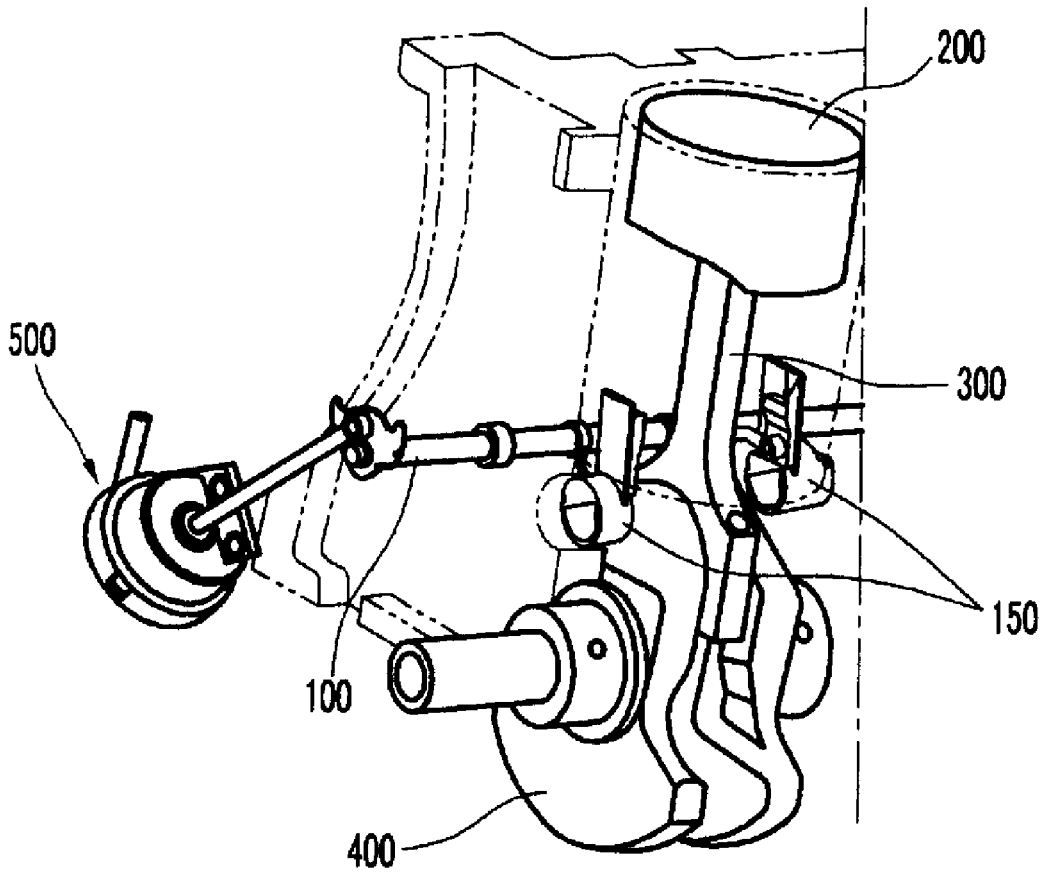
FIG. 1 is a perspective view of an exemplary variable compression ratio device applied to a cylinder block according to the present invention.

It should be understood that the appended drawings are not necessarily to scale, presenting a somewhat simplified representation of various features illustrative of the basic principles of the present invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION OF THE INVENTION

Reference will now be made in detail to various embodiments of the present invention(s), examples of which are illustrated in the accompanying drawings and described below. While the present invention(s) will be described in conjunction with exemplary embodiments, it will be understood that present description is not intended to limit the present invention(s) to those exemplary embodiments. On the contrary, the present invention(s) is/are intended to cover not only the exemplary embodiments, but also various alternatives, modifications, equivalents and other embodiments, which may be included within the spirit and scope of the present invention as defined by the appended claims.

An exemplary embodiment of the present invention will hereinafter be described in detail with reference to the accompanying drawings.

FIG. 1 is a perspective view of a variable compression ratio device applied to a cylinder block according to an exemplary embodiment of the present invention.

Figure 2:
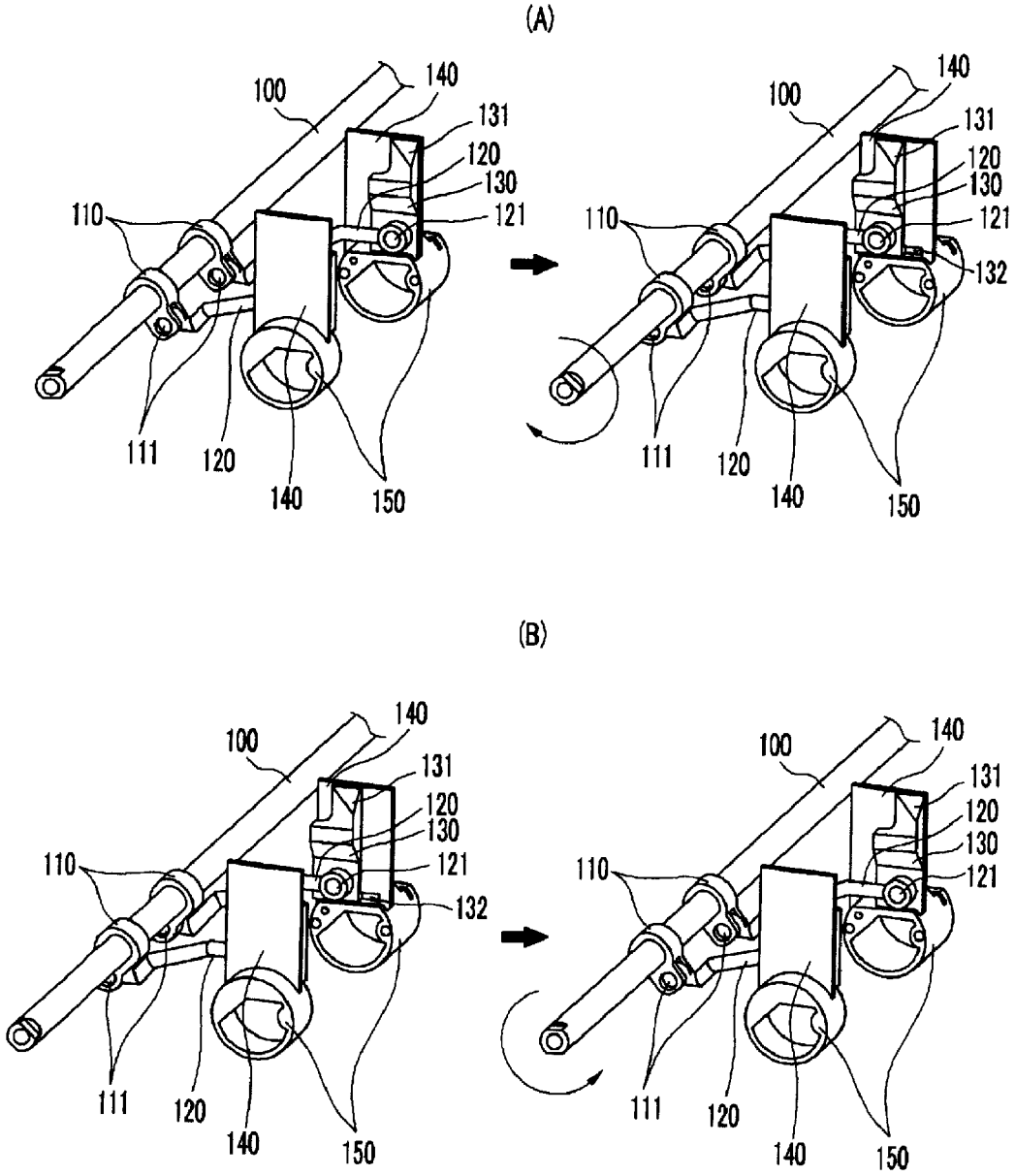
FIG. 2 shows an operating state of an exemplary variable compression ratio device in the case of converting from a low compression ratio to a high compression ratio or otherwise according to the present invention.

FIG. 2 shows an operating state of a variable compression ratio device in the case of converting from a low compression ratio to a high compression ratio or otherwise according to an exemplary embodiment of the present invention.

Figure 3:
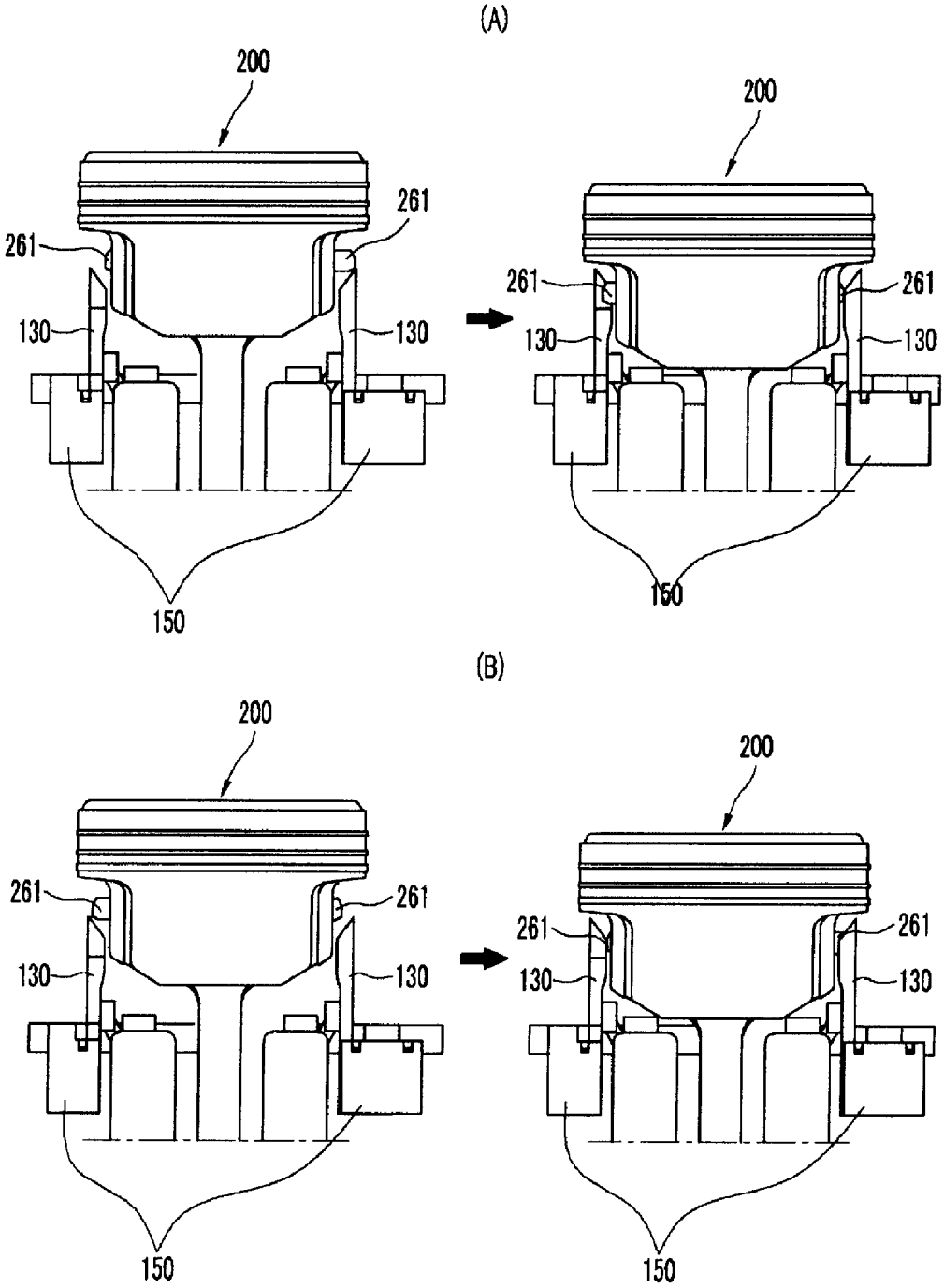
FIG. 3 shows a main portion of FIG. 2.

FIG. 3 shows a main portion of FIG. 2.

Figure 4:
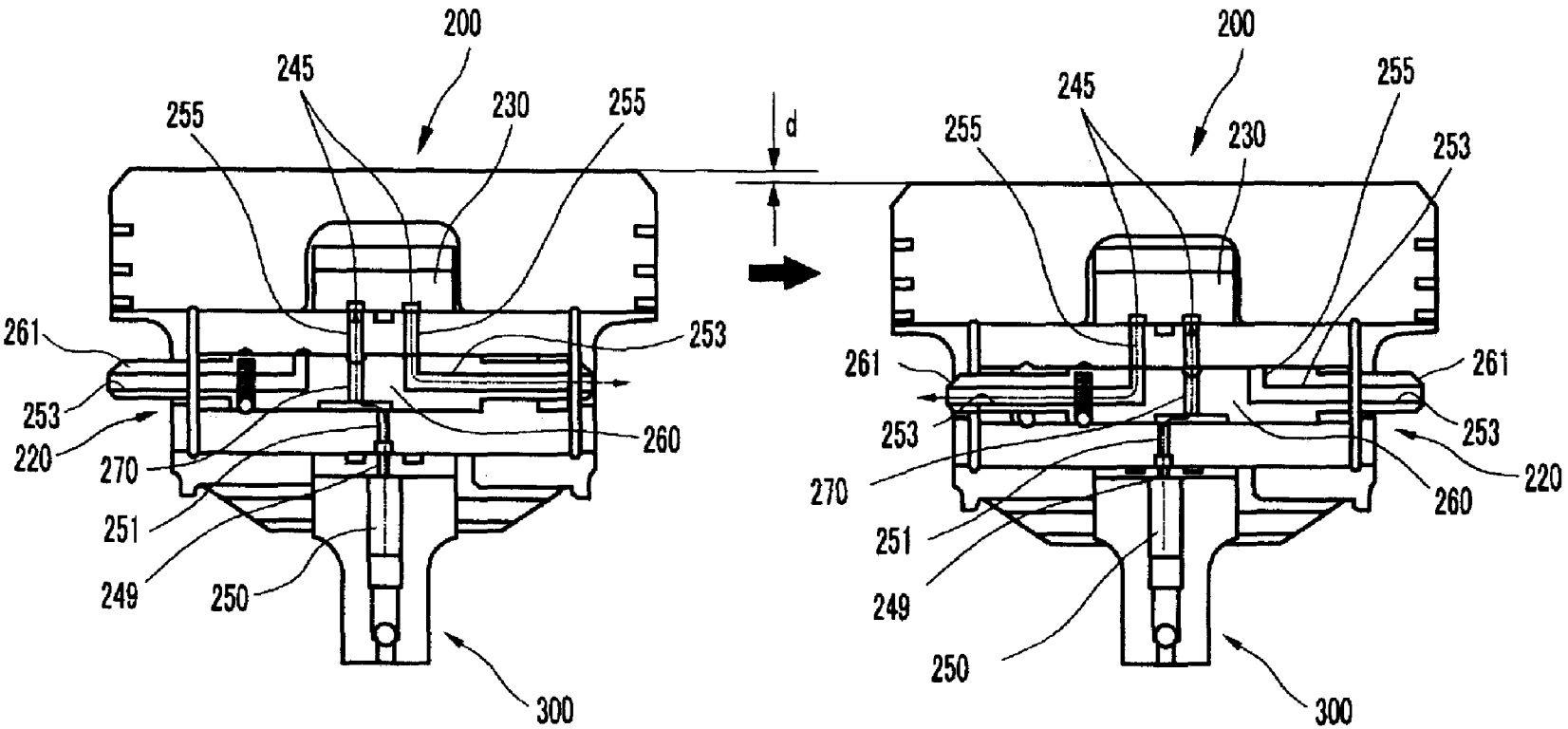
FIG. 4 shows an operating state of oil flow inside a piston in the case of converting from a high compression ratio to an exemplary low compression ratio according to the present invention.

FIG. 4 shows an operating state of oil flow inside a piston in the case of converting from a high compression ratio to a low compression ratio according to an exemplary embodiment of the present invention.

Figure 5:
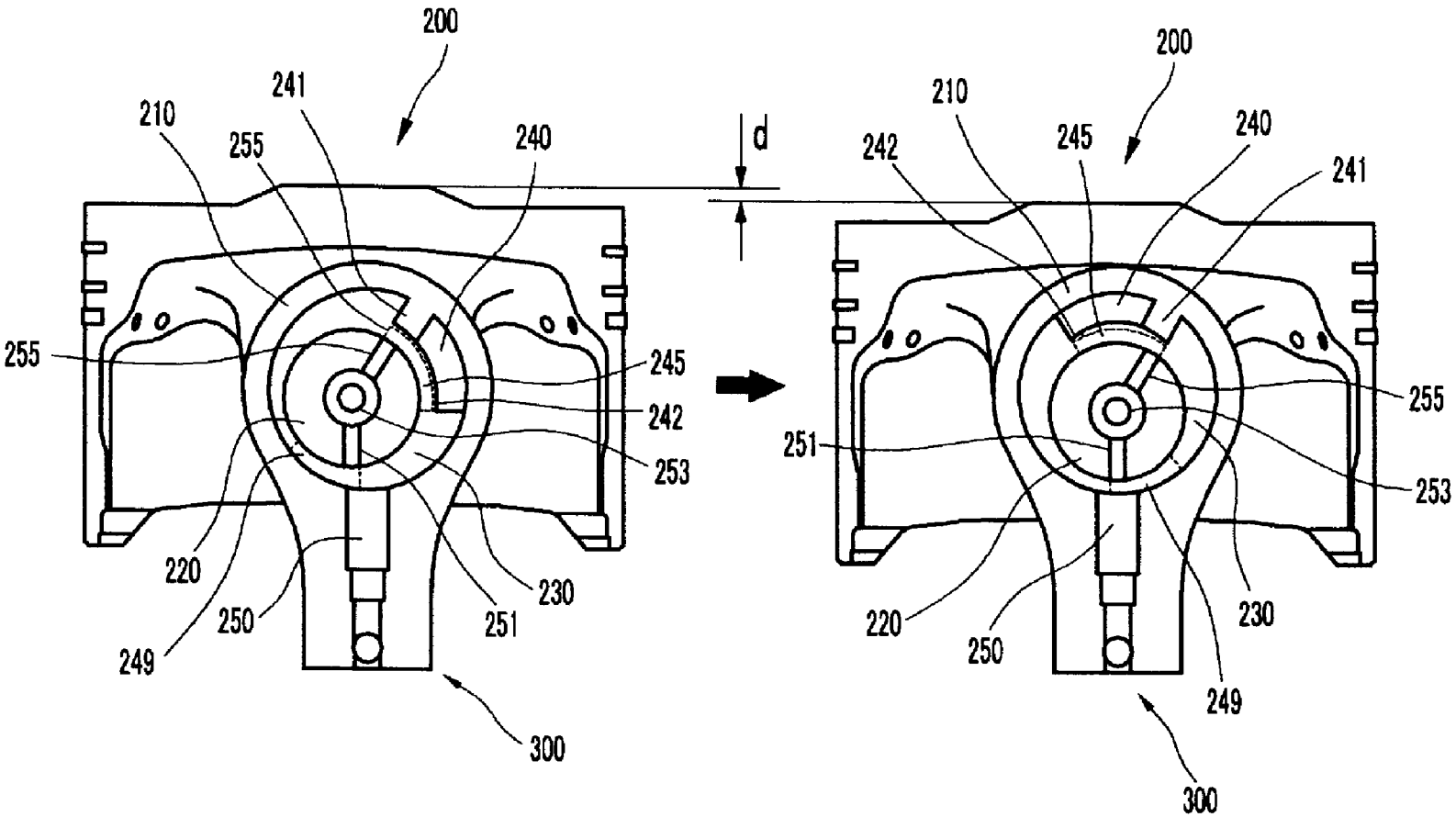
FIG. 5 is a cross-sectional view observed from a rotated direction of 90 degrees about the axis of FIG. 4.

FIG. 5 is a cross-sectional view observed from a rotated direction of 90 degrees about the axis of FIG. 4.

Figure 6:
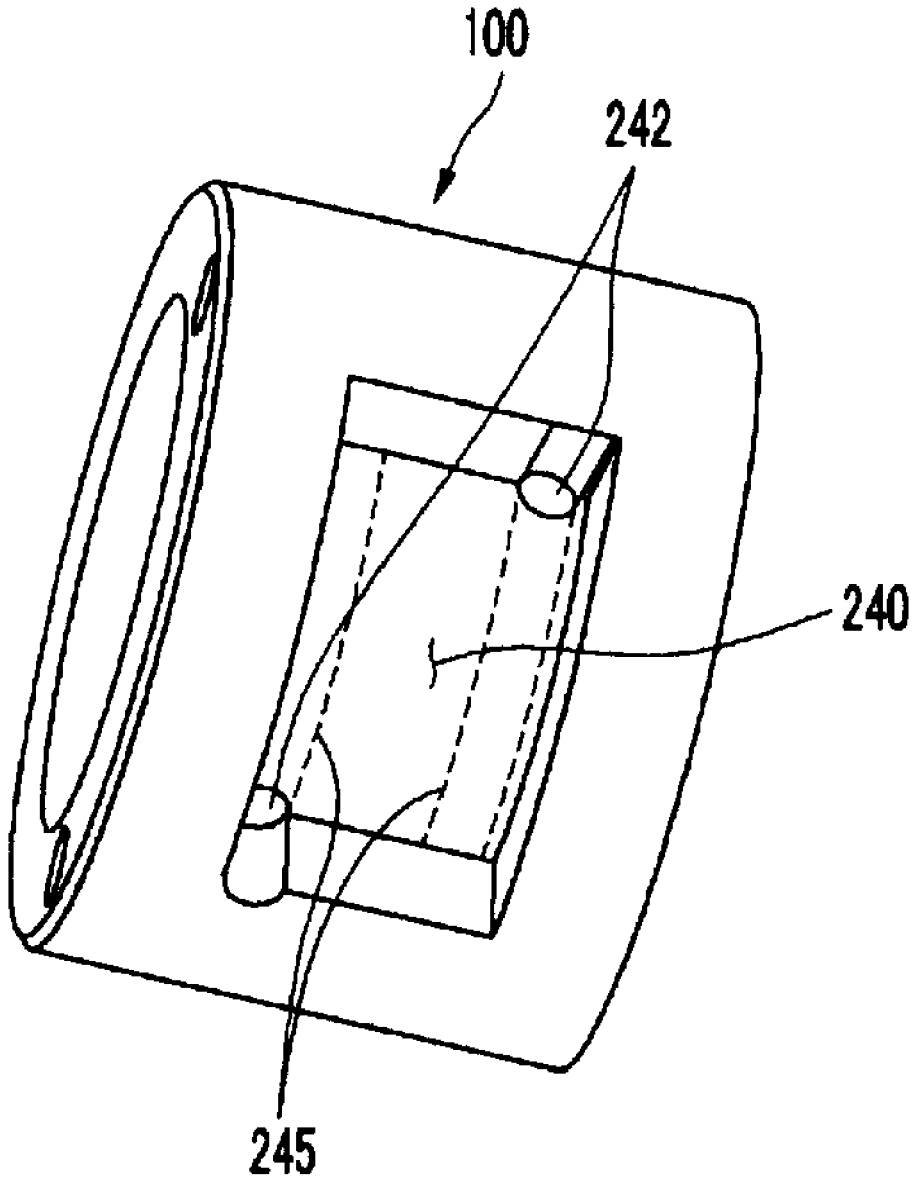
FIG. 6 is a perspective view of an eccentric bearing applied to an exemplary variable compression ratio device according to the present invention.

FIG. 6 is a perspective view of an eccentric bearing applied to a variable compression ratio device according to an exemplary embodiment of the present invention.

As shown in FIG. 1 to FIG. 6, a variable compression ratio device according to an exemplary embodiment of the present invention includes a variable shaft 100, a piston 200, a connecting shaft 120, and a variable slider 130.

The variable shaft 100 is rotatably mounted at an exterior portion of a cylinder block so as to be rotated selectively by an actuator 500.

The actuator 500 can be any device that is capable of operating the variable shaft 100, for example, a vacuum actuator and the like.

Herein, the piston 200, disposed within the cylinder block, reciprocates along an interior wall thereof, and then the crankshaft 400 mounted at a lower side thereof is rotated. The piston 200 and the connecting rod 300 are connected to each other by a ring 210 formed at a small end of a connecting rod 300.

Further, an eccentric bearing 230 is mounted between the ring 210 and a piston pin 220.

That is, an interior surface of the eccentric bearing 230 contacts an exterior circumference of the piston pin 220, the exterior circumference thereof contacts an interior circumference of the ring 210 formed at an end of the connecting rod 300, and the interior circumference thereof and the exterior circumference thereof are eccentric.

At this time, the eccentric bearing 230 for changing the compression ratio is coaxial with the piston pin 220, and an exterior circumference of the eccentric bearing 230 is eccentric from a central portion of the piston pin 220.

Further, an oil groove 240 is formed at an exterior circumference of the eccentric bearing 230.

Herein, a partition 241 for partitioning the oil groove 240 is formed at an interior circumference of the small end portion of the connecting rod 300.

Therefore, the oil groove 240 is separated by the partition 241. When hydraulic pressure is supplied to the oil groove 240, the eccentric bearing 230 rotates around the piston pin 220.

In addition, as shown in FIG. 6, two oil holes 242 are provided to distal end portions of an oil groove 240 in the eccentric bearing 230.

When one oil hole 242 may be a hole for supplying oil to the inside thereof, and the other oil hole 242 may be a hole for exhausting the oil out of the oil groove 240 and vice versa.

The eccentric bearing 230 may further include inner grooves 245 formed along an inner surface of the eccentric bearing 230 and fluidly-connected to the oil holes 242 respectively.

Further, a separate oil supply passage 250 can be provided to the inside of the connecting rod 300 so as to supply oil to the oil groove 240.

A ratchet rod 260 is mounted so that it is moved along a hollow wall formed inside the piston pin 220.

The eccentric bearing 230 includes an oil input passage 249 to fluid-communicate with the oil supply passage 250 of the connecting rod 300 and the piston pin 220 includes an oil inlet passage 251 to be fluid-connected to the oil input passage 249 of the eccentric bearing 230.

Thus, during the reciprocal motion of the ratchet rod 260, the oil inlet passage 251 of the piston pin 220 receives oil from the oil supply passage 250 of the connecting rod 300 through the oil input passage 249 and the oil inlet passage 251.

The piston pin 220 includes two oil outlet passages 255 and the control oil passage 270 is selectively connected to one of the two oil outlet passages 255 during the reciprocal motion of the ratchet rod 260.

The two oil outlet passages 255 of the piston pin 220 fluid-communicates with respective inner groove 245 of the eccentric bearing 230, wherein the respective inner groove 245 is fluid-connected to the oil hole 242 each other.

Herein, as shown in FIG. 4, the oil discharge passage 253 is formed inside the ratchet rod 260 at both end portions of thereof and a control oil passage 270 is formed in a middle portion around the outer circumference thereof.

Thus, according to reciprocal motion of the ratchet rod 260, oil is supplied though the oil supply passage 250, and then the oil is selectively supplied to one side of the oil groove 240 partitioned by the partition 241 through the oil holes 242 by the control oil passage 270 which is connected to one of the oil outlet passages 255.

In contrast, while the control oil passage 270 is connected to one of the oil outlet passages 255, the other one of the oil outlet passages 255 is connected to one of the discharge passage 253 such that oil in the other side of the oil groove 240 partitioned by the partition 241 is discharged through the one of the discharge passage 253.

At this time, the variable shaft 100 is rotated by a separate actuator 500 along an axial direction.

The actuator 500 can be an actuator of a vacuum type as mentioned above.

Two adaptors 110 are mounted at respectively exterior circumferences of the variable shaft 100.

The pair of adaptors 110 performs an integral operation of the pair of the connecting shafts 120 and the pair of variable sliders 130 according to rotation of the variable shaft 100.

As shown in FIG. 2, a first hinge 111 is formed at one end of the adaptor 110.

The adaptor 110 is connected to the connecting shaft 120 through the first hinge 111, and the connecting shaft 120 is connected to the variable slider 130 through a second hinge 121 formed at other end of the connecting shaft 120.

That is, when the variable shaft 100 is rotated in one direction by the actuator 500, rotary motion of the connecting shaft 120 converts motion of the variable shaft 100 to linear motion through the first hinge 111 via the adaptor 110.

In this way, the variable slider 130 connected to the second hinge 121 is moved linearly through the connecting shaft 120.

Herein, a guide plate 140 is disposed at the variable slider 130 for guiding linear motion thereof, and a guide rail 132 is provided therein.

Further, each of protrusions 131 is formed at a facing surface of the each variable slider 130.

The protrusions 131 are disposed so as to correspond to both ends 261 of the ratchet rod 260.

Further, both sides of the protrusion 131 are relocated back and forth.

When both variable sliders 130 are located in the virtual line facing each other straightly, the protrusion 131 is relocated in the virtual line. At this time, when the variable slider 130 is selectively moved back and forth, one of the variable sliders 130 exerts force on one end 261 of the ratchet rod 260.

The guide plate 140 is provide for guiding linear motion of the variable slider 130 through the guide rail 132, and is formed with a large plate shape for securing movement distance.

Further, a fixing block 150 is formed at a lower side of the guide plate 140 so as to support the variable slider 130 and the guide plate 140.

The fixing block 150 supports the variable slider 130 and guide plate 140 to the inside of the cylinder block through a fixing member.

Operation of a variable compression ratio device according to an exemplary embodiment of the present invention will hereinafter be described in detail.

Firstly, a rotary direction of the variable shaft 100 is selectively controlled by the actuator 500.

As shown in (A) of FIG. 2 and (A) of FIG. 3, when the variable shaft 100 is rotated in a clockwise direction in the case of converting from a low compression ratio to a high compression ratio, the connecting shaft 120 and the variable slider 130 are moved toward the variable shaft 100.

Then, a protrusion 131 formed at one variable slider 130 exerts force on one end portion 261 of the ratchet rod 260.

At this time, the ratchet rod 260 is slidably moved as shown in left side of FIG. 4 so that the control oil passage 270 supplies oil to the left oil outlet passage 255 in FIG. 4, and the device according to the exemplary embodiment of the present invention realizes the high compression ratio as shown in left side of the FIG. 5.

As shown in B of FIG. 2 and B of FIG. 3, in the case of converting to a low compression ratio, the device is operated in an opposite fashion.

At this time, the ratchet rod 260 is slidably moved as shown in right side of FIG. 4 so that the control oil passage 270 supplies oil to the right oil outlet passage 255 in FIG. 4, and the device according to the exemplary embodiment of the present invention realizes the low compression ratio as shown in right side of the FIG. 5.

Thus, as shown in FIG. 4 and FIG. 5, the control oil passage 270 is selectively communicated with one of the oil outlet passages 255, and thereby the oil is supplied to a target oil hole 242 of the eccentric bearing 230.

In this way, because the oil is selectively supplied to one oil groove 240 separated by the partition 241 through a sliding motion of the ratchet rod 260, the eccentric bearing 230 is rotated in one direction.

Therefore, as shown in FIG. 4 and FIG. 5, the height of the piston 200 is variable by the height d by the eccentric bearing 230 so as to control the compression ratio inside the cylinder.

As can be seen from the foregoing, a variable compression ratio device has advantages of reducing the number of parts and simplifying the structure because hydraulic pressure or an electric motor for rotating an eccentric bearing is omitted.

For convenience in explanation and accurate definition in the appended claims, the terms "inside", "interior", and "exterior" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A variable compression ratio device including a piston, a crankshaft, and a connecting rod including a small end rotatably connected to the piston by a piston pin and a big end rotatably connected to the crankshaft, comprising:

an eccentric bearing that contacts an exterior circumference of the piston pin, wherein an exterior circumference of the eccentric bearing contacts an interior circumference of a ring formed at the small end of the connecting rod and a central portion of the exterior circumference of the eccentric bearing is eccentric with a central portion of an interior circumference thereof;

a ratchet rod slidably coupled inside the piston pin and movable along a longitudinal direction therein to make selectively a relative rotation between the eccentric bearing and the small end of the connecting rod in accordance with a longitudinal motion of the ratchet rod;

a variable slider that selectively contacts one of both ends of the ratchet rod, and that is disposed at both sides of a cylinder for pushing the one of both ends of the ratchet rod in an opposite direction; and a guide plate for reciprocally moving both variable sliders along a vertical direction of the ratchet rod, wherein one end of the variable shaft is connected to the variable slider, and a sliding direction of the variable slider is controlled by a rotation of the variable shaft.

2. The device of claim 1, further comprising an oil groove formed at the exterior circumference of the eccentric bearing, wherein a partition partitioning the oil groove is integrally formed at an interior circumference of the ring in the small end and engaged in the oil groove, and wherein oil holes are formed in the oil groove in lateral side thereof in a circumferential direction thereof.

3. The device of claim 2, further comprising an oil supply passage formed inside the connecting rod for supplying oil to the oil groove through the oil holes.

4. The device of claim 3, wherein the eccentric bearing includes an oil input passage fluid-connected to the oil supply passage of the connecting rod.

5. The device of claim 4, wherein the piston pin includes an oil inlet passage fluid-connected to the oil input passage of the eccentric bearing and includes oil outlet passages.

6. The device of claim 5, wherein a control oil passage is formed along outer circumference of the ratchet rod, and the oil supplied from the oil supply passage through the oil input passage of the eccentric bearing and the oil inlet passage of the piston pin is selectively supplied to one of the oil outlet passages according to a reciprocal motion of the ratchet rod, by the control oil passage of the piston pin being selectively connected to the one of the oil output passages of the piston pin which is fluid-connected to one side of the oil groove separated by the partition.

7. The device of claim 6, wherein the eccentric bearing includes inner grooves formed along inner circumference thereof and fluid-communicating with respective oil outlet passage of the piston pin and respectively fluid-connected to the oil holes formed in the one side and the other side of the oil groove.

8. The device of claim 6, wherein an adaptor is mounted at an exterior circumference of the variable shaft so as to rotate together, the variable shaft and the connecting shaft are connected to each other by a first hinge disposed at the adaptor, the connecting shaft is connected to the variable slider by a second hinge, and rotary motion of the connecting shaft is converted to reciprocal motion by the first hinge and the second hinge.

9. The device of claim 1, wherein a protrusion is formed at an interior circumference of the variable slider so as to be respectively corresponded to both ends of the ratchet rod, and both protrusions are disposed so as to be respectively relocated back and forth about each moving direction.

10. The device of claim 1, wherein the variable shaft and the variable slider are connected by a connecting shaft.

11. The device of claim 1, wherein a guide rail is formed at one side of the guide plate for guiding the variable slider to move reciprocally back and forth, and a fixing block is formed at a lower side thereof for fixedly connecting the guide plate.

12. The device of claim 1, wherein the variable shaft is operated by a separate actuator of a vacuum type.

13. A variable compression ratio device including a piston, a crankshaft, and a connecting rod including a small end rotatably connected to the piston and a big end rotatably connected to the crankshaft, comprising:

an eccentric bearing that contacts an exterior circumference of a piston pin, wherein an exterior circumference of the eccentric bearing contacts an interior circumference of a ring formed at the small end of the connecting rod and a central portion of an exterior circumference of the eccentric bearing is eccentric with a central portion of an interior circumference thereof;

a ratchet rod disposed at a hollow portion formed inside the piston pin, and that is slidably mounted along a longitudinal direction therein;

a variable slider that is disposed so as to selectively contact one of both ends of the ratchet rod, and that is disposed at both sides of a cylinder for pushing the one of the both ends of the ratchet rod in an opposite direction;

a guide plate for reciprocally moving both variable sliders along a vertical direction of the ratchet rod; and a connecting shaft for connecting the variable shaft and the variable slider;

wherein an adaptor is mounted at an exterior circumference of the variable shaft so as to rotate together, the variable shaft and the connecting shaft are connected to each other by a first hinge disposed at the adaptor, the connecting shaft is connected to the variable slider by a second hinge, and rotary motion of the connecting shaft is converted to reciprocal motion by the first hinge and the second hinge.

14. A variable compression ratio device including a piston, a crankshaft, and a connecting rod including a small end rotatably connected to the piston and a big end rotatably connected to the crankshaft, comprising:

an eccentric bearing that contacts an exterior circumference of a piston pin, wherein an exterior circumference of the eccentric bearing contacts an interior circumference of a ring formed at an end of the connecting rod and a central portion of the exterior circumference of the eccentric bearing is eccentric with an interior circumference thereof;

a ratchet rod disposed at a hollow portion formed inside the piston pin, and that is slidably mounted along a longitudinal direction therein;

a variable slider that selectively contacts one of both ends of the ratchet rod, and that is disposed at both sides of a cylinder for pushing the one of both ends of the ratchet rod in an opposite direction;

a guide plate for reciprocally moving both variable sliders along a vertical direction of the ratchet rod; and a connecting shaft for connecting the variable shaft and the variable slider;

a guide rail formed at one side of the guide plate for guiding the variable slider to move reciprocally back and forth; and a fixing block formed at a lower side of the guide rail for fixedly connecting the guide plate;

wherein an adaptor is mounted at an exterior circumference of the variable shaft so as to rotate together, the variable shaft and the connecting shaft are connected to each other by a first hinge disposed at the adaptor, the connecting shaft is connected to the variable slider by a second hinge, and rotary motion of the connecting shaft is converted to reciprocal motion by the first hinge and the second hinge.

* * * * *